US012467197B2

(12) United States Patent
Tanaka et al.

(10) Patent No.: US 12,467,197 B2
(45) Date of Patent: Nov. 11, 2025

(54) APPARATUS AND METHOD FOR APPLYING HYDROXYAPATITE TO NONWOVEN FABRIC

(71) Applicant: Brainy Inc., Chiba (JP)

(72) Inventors: Nobukiyo Tanaka, Okinawa (JP); Masashi Tanaka, Chiba (JP)

(73) Assignee: Brainy Inc., Chiba (JP)

( * ) Notice: Subject to any disclaimer, the term of this patent is extended or adjusted under 35 U.S.C. 154(b) by 2 days.

(21) Appl. No.: 18/677,520

(22) Filed: May 29, 2024

(65) Prior Publication Data

US 2024/0309579 A1 Sep. 19, 2024

Related U.S. Application Data

(63) Continuation of application No. PCT/JP2022/012339, filed on Mar. 17, 2022.

(51) Int. Cl.

| | |
|---|---|
| ***D06M 10/02*** | (2006.01) |
| ***B05C 3/05*** | (2006.01) |
| ***D06B 3/20*** | (2006.01) |
| ***D06M 10/06*** | (2006.01) |
| ***D06M 16/00*** | (2006.01) |

(52) U.S. Cl.
CPC ..... *D06M 10/06* (2013.01); *D06B 3/208* (2013.01); *D06M 10/02* (2013.01); *D06M 16/00* (2013.01)

(58) Field of Classification Search
CPC ..... B05C 3/12; B05C 3/05; D06M 16/00; D06M 10/02
See application file for complete search history.

(56) References Cited

U.S. PATENT DOCUMENTS

| | | | | |
|---|---|---|---|---|
| 4,353,934 | A * | 10/1982 | Nakashima | B01D 19/0078 427/601 |
| 2011/0232653 | A1* | 9/2011 | Imashiro | B32B 5/022 977/700 |
| 2018/0371203 | A1* | 12/2018 | Ishihara | C08J 11/10 |
| 2020/0069730 | A1* | 3/2020 | Okazaki | A61K 33/242 |

FOREIGN PATENT DOCUMENTS

| | | | | |
|---|---|---|---|---|
| JP | S63199612 | | 8/1988 | |
| JP | 2010005211 | | 1/2010 | |
| JP | 2017127798 | | 7/2017 | |
| JP | 2017127798 | A * | 7/2017 | |
| JP | 2018110557 | | 7/2018 | |
| JP | 2019127468 | | 8/2019 | |
| KR | 20190010356 | A * | 1/2019 | D06C 23/04 |
| WO | 2018198296 | | 11/2018 | |

OTHER PUBLICATIONS

International Search Report issued in corresponding International Application PCT/JP2022/012339, mailed May 24, 2022.

* cited by examiner

*Primary Examiner* — Cachet I Proctor
(74) *Attorney, Agent, or Firm* — Burris Law, PLLC

(57) ABSTRACT

According to an embodiment, an apparatus for applying hydroxyapatite to a nonwoven fabric includes a tank, a shower head, an ultrasonic wave generator, and a drying section. The tank stores suspension containing hydroxyapatite. The shower head jets the suspension against the nonwoven fabric in the suspension in the tank. The ultrasonic wave generator emits ultrasonic waves against the nonwoven fabric. The drying section dries the nonwoven fabric in a wet state removed from the suspension in the tank.

8 Claims, 5 Drawing Sheets

APPARATUS AND METHOD FOR APPLYING HYDROXYAPATITE TO NONWOVEN FABRIC

CROSS-REFERENCE TO RELATED APPLICATIONS

This application is a Continuation application of PCT Application No. PCT/JP2022/012339, filed Mar. 17, 2022, the entire contents of which are incorporated herein by reference.

BACKGROUND OF THE INVENTION

1. Field of the Invention

The present invention relates generally to an apparatus and method for applying hydroxyapatite to a nonwoven fabric.

2. Description of the Related Art

Hydroxyapatite (hereinafter referred to as HA) is represented, for example, by $Ca_{10}(PO_4)_6(OH)_2$. HA is a type of potassium phosphate. One type of HA is silver-containing hydroxyapatite (hereinafter referred to as AgHA). The smaller the particle size of AgHA, the higher the adhesion between AgHA and other substances. AgHA has antibacterial and deodorizing effects and is harmless to the human body.

BRIEF SUMMARY OF THE INVENTION

Embodiments described herein aim to provide an apparatus and method for applying HA to a nonwoven fabric.

An apparatus according to an embodiment of the present invention includes a tank, a shower head, an ultrasonic wave generator, and a drying section. The tank stores suspension containing hydroxyapatite. The shower head jets the suspension against a nonwoven fabric in the suspension in the tank. The ultrasonic wave generator emits ultrasonic waves against the nonwoven fabric. The drying section dries the nonwoven fabric in a wet state removed from the suspension in the tank.

A method according to an embodiment of the present invention includes immersing a nonwoven fabric in suspension containing hydroxyapatite stored in a tank, jetting the suspension against the nonwoven fabric by a shower head and emitting ultrasonic waves against the nonwoven fabric by an ultrasonic wave generator in the suspension in the tank, and drying the nonwoven fabric in a wet state removed from the suspension in the tank by a drying section.

According to an embodiment of the present invention, HA with small particle size can be applied to a nonwoven fabric.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the present invention will be described below with reference to the accompanying drawings. Note that, in the following description, functions and components that are almost or substantially the same are given the same symbols, and explanations thereof are omitted or given only when necessary.

First Embodiment

In a first embodiment, AgHA is applied to a nonwoven fabric by immersing the nonwoven fabric in suspension of AgHA. In the first embodiment, application is assumed to be a technique that utilizes wetting and solidification.

Note that, in the first embodiment, as an example of hydroxyapatite, a case where AgHA is applied to a nonwoven fabric is described; however, the same apparatus and method can also be applied in a case of applying other hydroxyapatite that does not contain silver to a nonwoven fabric. Specifically, hydroxyapatite may also contain an antimicrobial heavy metal such as copper, palladium, platinum, cadmium, nickel, cobalt, zinc, manganese, thallium, lead, or mercury.

Figure 1:
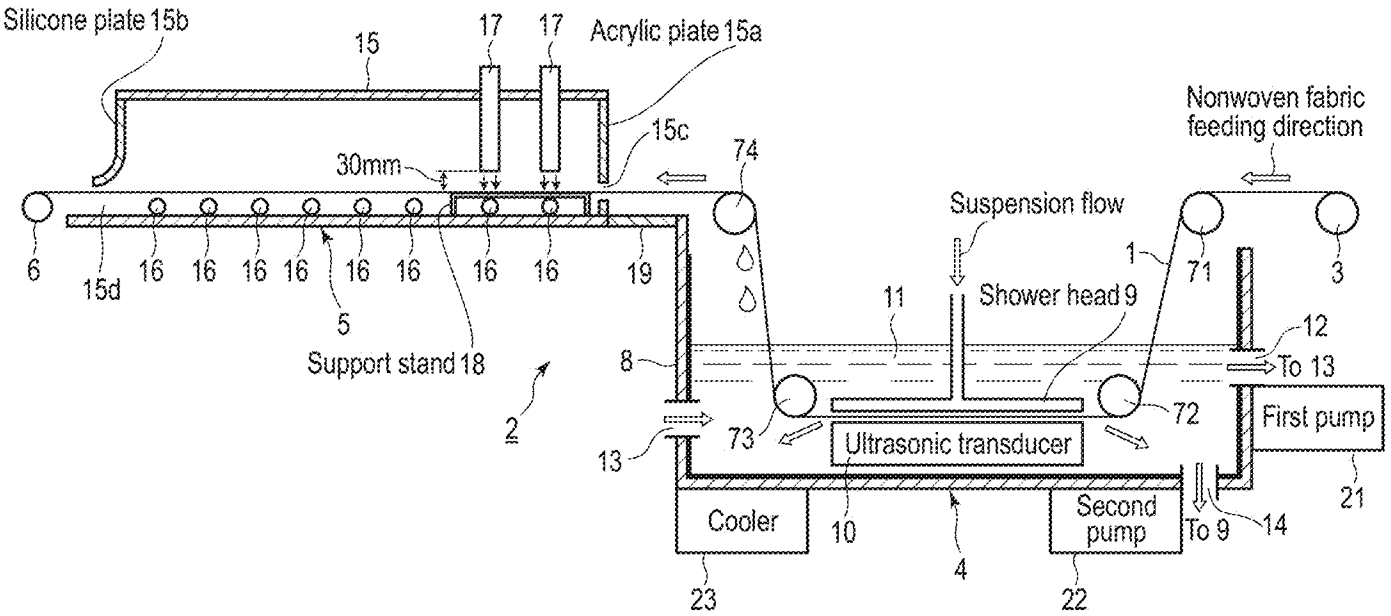
FIG. 1 is a conceptual diagram showing an example of a configuration of an application apparatus for applying AgHA to a nonwoven fabric according to a first embodiment.

FIG. 1 is a conceptual diagram showing an example of a configuration of an application apparatus 2 for applying AgHA to a nonwoven fabric 1 according to the first embodiment. FIG. 1 exemplifies a side cross-sectional view of the application apparatus 2.

The application apparatus 2 mainly includes a feeder 3 that feeds the nonwoven fabric 1 before treatment, a tank section 4, a drying section 5, a winding section 6 that winds the nonwoven fabric 1 after treatment, and a droplet receiving section 19.

Continuous nonwoven fabric 1 is fed from the feeder 3, positioned by rollers 71 to 74 of the tank section 4 and rollers 16 of the drying section 5, and moved from right to left in FIG. 1 by the winding performed by the winding section 6. This right-to-left direction in FIG. 1 is described as a nonwoven fabric feeding direction.

The tank section 4 includes the rollers 71 to 74, a tank 8, a first pump 21, a second pump 22, a shower head 9, an ultrasonic transducer 10, and a cooler 23.

The rollers 71 and 72 guide the nonwoven fabric fed from the feeder 3 into AgHA suspension liquid 11 stored in the tank 8.

The roller 72 further guides the nonwoven fabric 1 between the shower head 9 and the ultrasonic transducer 10.

The rollers 73 and 74 guide the nonwoven fabric 1 that has passed between the shower head 9 and the ultrasonic transducer 10 out of the suspension 11 stored in the tank 8.

The roller 74 further returns excess suspension contained in the nonwoven fabric 1 from the nonwoven fabric 1 to the tank 8.

The water tank 8 stores the suspension 11. The tank 8 is provided with a first outlet 12, an inlet 13, and a second outlet 14.

The first outlet 12 is provided on a first side of the tank 8.

The inlet 13 is provided on a second side of the tank 8. The second side may be a side facing the first side.

The first pump 21 discharges the suspension 11 out of the tank 8 from the first outlet 12 and allows the suspension 11 to flow into the tank 8 from the inlet 13. This causes the suspension 11 to flow within the tank 8.

The second outlet 14 is provided at the bottom of the tank 8.

The second pump 22 discharges the suspension 11 out of the tank 8 from the second outlet 14 and supplies the suspension 11 to the shower head 9. This allows the suspension 11, which exists deep in the tank 8 and has a high concentration of AgHA, to be supplied to the shower head 9, causing the suspension 11 to jet out from the shower head 9 and causing the suspension 11 to flow within the tank 8.

The shower head 9 jets out the suspension 11 from a liquid jetting surface. The liquid jetting surface of the shower head 9 faces a vibrating surface of the ultrasonic transducer 10 through a gap.

The ultrasonic transducer 10 is an example of an ultrasonic wave generator. The ultrasonic transducer 10 vibrates at a high frequency and emits ultrasonic waves from an ultrasonic emission surface. The ultrasonic transducer 10 may, for example, be a device that emits powerful ultrasonic waves for cell disruption. The ultrasonic emission surface of the ultrasonic transducer 10 faces a liquid discharge surface of the shower head 9 through a gap.

In the first embodiment, the shower head 9 is placed on upper side and the ultrasonic transducer 10 is placed on lower side.

The gap between the liquid discharge surface of the shower head 9 and the vibrating surface of the ultrasonic transducer 10 is, for example, larger than the thickness of the nonwoven fabric 1 and 3 mm or less. From results of experiment, it was possible to soak the suspension 11 into the nonwoven fabric 1 even when the gap was, for example, 6.5 mm or less. By making the ultrasonic waves more powerful and/or the water flow of the suspension 11 more powerful, the gap can be applied in the range of 50 mm or less.

The nonwoven fabric 1 that has passed through the gap between the shower head 9 and the ultrasonic transducer 10 becomes soaked with the suspension 11.

The cooler 23 suppresses the temperature rise of the suspension 11 in the tank 8 due to ultrasonic waves. More specifically, the cooler 23 operates when the temperature of the suspension 11 in the tank 8 exceeds a threshold value to lower the temperature of the suspension 11.

The droplet receiving section 19 is arranged between the tank section 4 and the drying section 5. The droplet receiving section 19 receives droplets of the suspension 11 dripping from the nonwoven fabric 1.

The drying section 5 includes an enclosure 15, a plurality of rollers 16, a blowout port 17, and a support stand 18.

The surface of the enclosure 15 on the side from which the nonwoven fabric 1 is carried in may be, for example, a transparent acrylic plate 15*a*. By using the transparent acrylic plate 15*a*, an operator can easily observe the inside condition of the drying section 5. The acrylic plate 15*a* has an opening 15*c* for carrying the nonwoven fabric 1 from the outside of the enclosure 15 to the inside.

The surface of the enclosure 15 on the side from which the nonwoven fabric 1 is carried out may be, for example, a flexible silicone plate 15*b*. The silicone plate 15*b* is, for example, connected to an upper surface of the enclosure 15 only at the top, and is arranged like a hanging curtain. The operator can raise this silicone plate 15*b* to set and change the inside of the enclosure 15. By using the flexible silicone plate 15*b* in this manner, the operator can easily observe and change the inside condition of the drying section 5. The use of the flexible silicone plate 15*b* also allows gas such as air inside the enclosure 15 to be discharged flexibly. The silicone plate 15*b* has an opening 15*d* for carrying the nonwoven fabric 1 from the inside of the enclosure 15 to the outside.

The plurality of rollers 16 move the nonwoven fabric 1 carried in through the opening 15*c* formed in the acrylic plate 15*a* of the drying section 5 in a manner to be carried out through the opening 15*d* formed in the silicone plate 15*b* of the drying section 5.

The blowout port 17 discharges wind (e.g., warm wind) for drying the nonwoven fabric 1. In the first embodiment, the blowout port 17 discharges wind in a direction perpendicular to the plane of the nonwoven fabric 1 at the acrylic plate 15*a* side in the enclosure 15. More specifically, the blowout port 17 is arranged on the upper surface of the enclosure 15, on the side carrying in the nonwoven fabric 1 inside the enclosure 15, and discharges wind in a downward direction with respect to the nonwoven fabric 1. In the first embodiment, the shape of the blowout port 17 is preferably circular, for example; however, may be other shapes, such as an ellipse or a square.

On the roller 16 side of the nonwoven fabric 1 opposite to the blowout port 17 side, the support stand 18 is installed to prevent the nonwoven fabric 1 receiving the wind from being caught in the roller 16.

The support stand 18 is inside the enclosure 15 and supports the nonwoven fabric 1 on the carry-in side where the nonwoven fabric 1 receives wind.

In the first embodiment, the upper surface of the support stand 18 (the surface supporting the nonwoven fabric 1) is assumed to be net-like.

Figure 2:
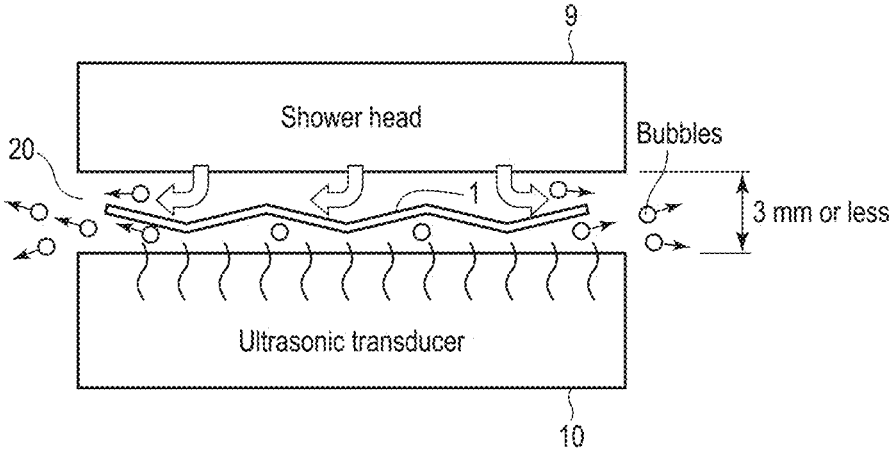
FIG. 2 is a side view showing an example of a shower head and an ultrasonic transducer.

FIG. 2 is a side view showing an example of the shower head 9 and the ultrasonic transducer 10.

The shower head 9 and the ultrasonic transducer 10 are provided facing each other through a gap 20 larger than the thickness of the nonwoven fabric 1 and 3 mm or less, for example. In the first embodiment, the shower head 9 is provided on the upper side and the ultrasonic transducer 10 is provided on the lower side. However, other arrangement relationships may be applied, such as the shower head 9 on the lower side and the ultrasonic transducer 10 on the upper side.

A plurality of holes are formed in the lower surface of the shower head 9. The suspension 11 is jetted from the holes on the lower side of the shower head 9 toward the nonwoven fabric 1.

The ultrasonic transducer 10 vibrates the nonwoven fabric 1 and the suspension 11 in the gap 20 by ultrasonic waves.

The nonwoven fabric 1 immersed in the suspension 11 in the tank 8 contains air bubbles. In the first embodiment, the suspension 11 jetted from the shower head 9 is pressed against the nonwoven fabric 1. The synergistic effect of the jet of suspension 11 and the ultrasonic waves generated by the ultrasonic transducer 10 expels the air bubbles from the nonwoven fabric 1, and the hydrophobic nonwoven fabric 1 is wetted by the suspension 11.

Figure 3:
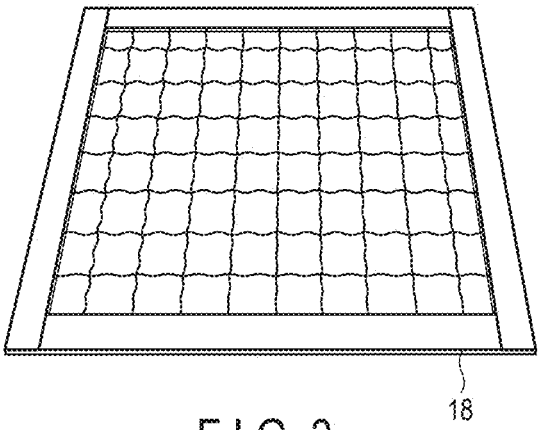
FIG. 3 is a perspective view showing an example of an upper surface of a support stand.

FIG. 3 is a perspective view showing an example of the upper surface of the support stand 18.

By making the upper surface of the support stand 18 net-like, the wind discharged from the blow out port 17 can blow through the nonwoven fabric 1 more efficiently, and furthermore, the nonwoven fabric 1 can be prevented from being caught in the roller 16 under the support stand 18.

Figure 4:
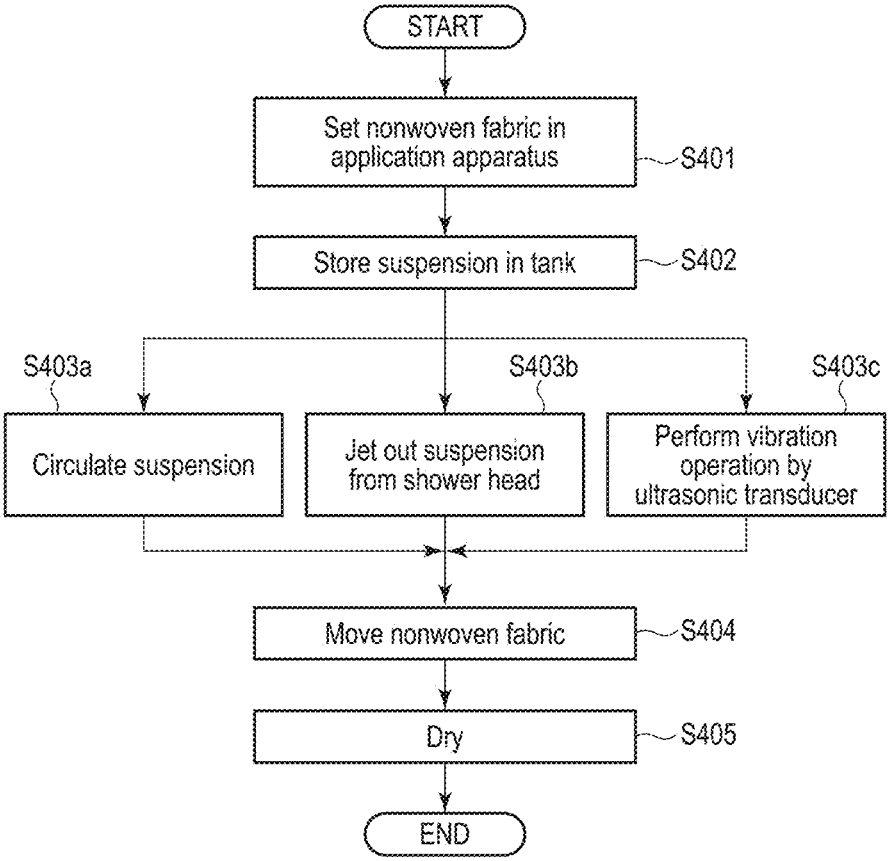
FIG. 4 is a flowchart showing an example of a method of applying AgHA to the nonwoven fabric performed by the application apparatus according to the first embodiment.

FIG. 4 is a flowchart showing an example of a method of applying AgHA to the nonwoven fabric 1 performed by the application apparatus 2 according to the first embodiment.

In step S401, the nonwoven fabric 1 is set in the application apparatus 2 in a state where it can move in the nonwoven fabric feeding direction from the feeder 3 to the winding section 6 via the tank section 4 and the drying section 5.

In step S402, the tank 8 stores the suspension 11.

In step S403*a*, the first pump 21 circulates the suspension 11 in the tank 8.

In step S403*b*, the second pump 22 supplies the suspension 11 in the tank 8 to the shower head 9, and the suspension 11 is jetted out from the shower head 9.

In step S403*c*, the ultrasonic transducer 10 emits ultrasonic waves to the nonwoven fabric 1 by vibration operation to remove air bubbles from the nonwoven fabric 1.

These steps S403*a* to S403*c* cause the suspension 11 to soak into the hydrophobic nonwoven fabric 1.

In step S404, the feeder 3, the rollers 71 to 74, the rollers 16, and the winding section 6 move the nonwoven fabric 1 in the nonwoven fabric feeding direction.

In step S405, the drying section 5 dries the nonwoven fabric 1 in which the suspension 11 is soaked by the wind discharged from the blowout port 17.

The effects of the first embodiment described above will be explained.

The particle size of AgHA in the suspension 11 is smaller than the dried AgHA. In the first embodiment, AgHA having a small particle size is applied to the nonwoven fabric 1 by soaking the suspension 11 into the nonwoven fabric 1 to make it wet, and then drying it.

In a case where the nonwoven fabric 1 is hydrophobic, simply immersing the nonwoven fabric 1 in the suspension 11 may not sufficiently soak the suspension 11 into the nonwoven fabric 1, and it may not be possible to sufficiently apply AgHA to the nonwoven fabric 1.

Therefore, in the first embodiment, the nonwoven fabric 1 is vibrated by the ultrasonic vibrator 10, and the suspension 11 is jetted out from the shower head 9 toward the nonwoven fabric 1 to generate a water flow; thereby, air bubbles are expelled from within the nonwoven fabric 1 to make the nonwoven fabric 1 wet with the suspension 11, and then the nonwoven fabric 1 is quickly dried. In the first embodiment, the shower head 9 contributes to the expulsion of air bubbles in addition to the uniform jetting of the suspension 11.

This allows AgHA, which is a suspended component with a small particle size, to adhere to the nonwoven fabric 1.

In the first embodiment, the concentration of the suspension 11 in the tank 8 can be made uniform by vibrating the suspension 11 using the ultrasonic transducer 10.

In the first embodiment, the nonwoven fabric 1 passes through the gap 20 between the shower head 9 and the ultrasonic transducer 10, which face each other. By making the width of this gap greater than the thickness of the nonwoven fabric 1 and 3 mm or less, the soaking of the suspension 11 into the nonwoven fabric 1 can be accelerated.

In the first embodiment, for example, the concentration of the suspension 11 may be 0.05% or higher and 0.5% or lower. In this case, AgHA can be sufficiently adhered to the nonwoven fabric 1, and it is possible to prevent AgHA from adhering excessively to the fibers of the nonwoven fabric 1 and causing AgHA powder to fall off.

An appropriate concentration of the suspension 11 depends on the particle size.

In a case where AgHA in the suspension 11 is micro-sized, experimental results show that the acceptable concentration range for nonwoven fabrics for mask filters, nonwoven fabrics for masks, nonwoven fabrics for diapers, and nonwoven fabrics for sanitary products is 0.005% or higher and 5.0% or lower, preferably 0.05% or higher and 0.5% or lower. Furthermore, in the case where AgHA in the suspension 11 is micro-sized, the experimental results show that the acceptable concentration range for nonwoven fabrics for mask filters, nonwoven fabrics for masks, nonwoven fabrics for diapers, and nonwoven fabrics for sanitary products is 0.005% or higher and 1.0% or lower, preferably 0.05% or higher and 0.1% or lower.

In a case where AgHA in the suspension 11 is nano-sized, experimental results show that the acceptable concentration range for nonwoven fabrics for mask filters and nonwoven fabrics for masks is 0.005% or higher and 5.0% or lower, preferably 0.05% or higher and 0.5% or lower. Furthermore, in the case where AgHA in the suspension 11 is nano-sized, the experimental results show that the acceptable concentration range for nonwoven fabrics for mask filters and nonwoven fabrics for masks is 0.005% or higher and 5.0% or lower, preferably 0.01% or higher and 1.0% or lower, and even more preferably 0.05% or higher and 0.5% or lower. In the case where AgHA in the suspension 11 is nano-sized, the experimental results show that the acceptable concentration range for nonwoven fabrics for diapers and nonwoven fabrics for sanitary products is 0.01% or higher and 5.0% or lower, preferably 0.05% or higher and 5.0% or lower, and even more preferably 0.1% or higher and 0.5% or lower.

In the case where AgHA is nano-sized, fine AgHA particles adhere more evenly to the nonwoven fabric than in the case where AgHA is micro-sized, resulting in a better application condition.

Experimental results showed that AgHA applied to the nonwoven fabric 1 by the first embodiment did not peel off even when exposed to a wind speed of 10 m/s (equivalent to the initial speed of a cough) for 10 seconds (equivalent to 50 times of coughing). In the first embodiment, the nonwoven fabric feeding speed, drying warm wind temperature, and wind speed appropriate for wetting the nonwoven fabric 1 with the suspension 11 and then drying it are determined from the results of experiments that the nonwoven fabric feeding speed is 0.05 cm/s or higher and 10 cm/s or lower, the outlet temperature of drying wind is 30° C. or higher and 200° C. or lower, and the wind speed of the drying wind is 1 m/s or higher and 10 m/s or lower. More preferably, the nonwoven fabric feeding speed, the drying warm wind temperature, and the wind speed are such that the nonwoven fabric feeding speed is 0.8 cm/s or higher and 1 cm/s or lower, the outlet temperature of the drying wind is 85° C. or higher and 95° C. or lower, and the wind speed of the drying wind is 7 m/s or higher and 8 m/s or lower. An appropriate drying wind outlet temperature was, for example, 90° C. Note that the temperature of the warm wind may be increased in the case where the nonwoven fabric feeding speed is increased. The application apparatus 2 according to the first embodiment can, for example, realize the temperature of the drying wind in the range of 500° C. or lower, and, for example, realize the nonwoven fabric feeding speed in the range of 1000 cm/s or lower, for example, along the winding speed by the winding section 6. The maximum wind speed of the drying wind can be set within a range where the suspension 11 is not blown away from the nonwoven fabric 1, which would not cause AgHA to be difficult to adhere to the nonwoven fabric 1.

The tank 8 may be refilled with the suspension 11 so that the concentration of the suspension 11 in the tank 8 is equal to or above a predetermined value.

In the first embodiment, by adjusting the flow rate of the suspension 11 jetted from the shower head 9 and by applying ultrasonic waves to the nonwoven fabric 1 by the ultrasonic transducer 10, air bubbles in the nonwoven fabric 1 can be efficiently discharged to make the nonwoven fabric 1 wet with the suspension 11.

In the first embodiment, the case where AgHA is applied to the nonwoven fabric 1 is described, but the same apparatus and method can also be applied to a case where HA is applied to the nonwoven fabric 1 instead of AgHA.

In the first embodiment, the shower head 9 and the ultrasonic transducer 10 are used to wet the hydrophobic nonwoven fabric 1. However, in the case where the nonwoven fabric is hydrophilic, the nonwoven fabric can be made wet without using the ultrasonic transducer 10.

In the first embodiment, the nonwoven fabric 1 passes between the shower head 9 and the ultrasonic transducer 10, and excess suspension on the nonwoven fabric 1 is squeezed off by the roller 74 and returned to the water tank 8. The moderately wet nonwoven fabric 1 is then transported to the inside of the drying section 5. By spraying the suspension 11 from the shower head 9 in this manner, the efficiency of wetting the nonwoven fabric 1 can be improved and the suspension 11 in the tank 8 can be agitated.

In the first embodiment, in addition to the flow generated by the shower head 9, the suspension 11 that has flowed out from the first outlet 12 is allowed to flow in through the inlet 13, which further agitates and circulates the suspension 11 in the tank 8. This allows the concentration of the suspension 11 in the tank 8 to be made uniform, enabling the AgHA to be applied uniformly to the nonwoven fabric 1.

Second Embodiment

In a second embodiment, a state is described in which AgHA is applied to the nonwoven fabric 1, which is a nonwoven fabric for a mask filter or a mask, by the application apparatus 2 and the application method according to the first embodiment above, and then a strong wind is applied to a surface of the nonwoven fabric 1.

Figure 5:
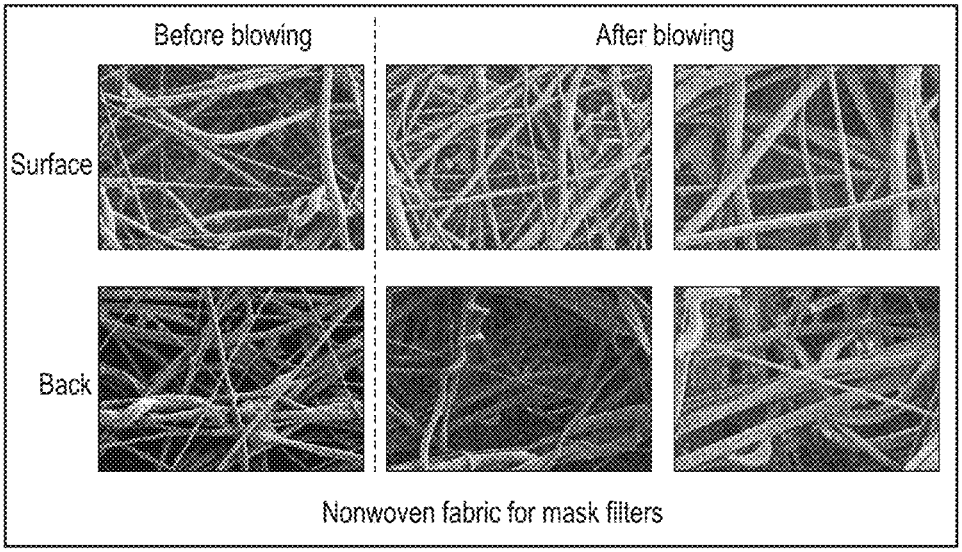
FIG. 5 is an enlarged view showing examples of states in which strong winds are applied to nonwoven fabrics for mask filters after applying AgHA.

FIG. 5 is an enlarged view showing examples of states in which strong winds are applied to the nonwoven fabrics for mask filters after applying AgHA. This FIG. 5 shows surfaces and back surfaces before and after air blowing against the nonwoven fabrics for mask filters.

Figure 6:
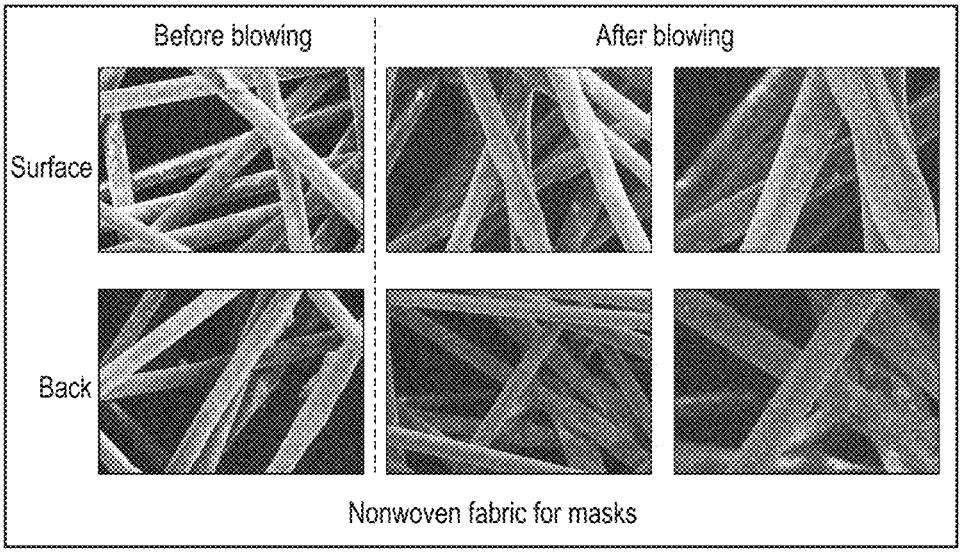
FIG. 6 is an enlarged view showing examples of states in which strong winds are applied to nonwoven fabrics for masks after applying AgHA.

FIG. 6 is an enlarged view showing examples of states in which strong winds are applied to the nonwoven fabrics for masks after applying AgHA. This FIG. 6 shows surfaces and back surfaces before and after air blowing against the nonwoven fabrics for masks.

The average initial velocity of coughing is 10 m/s, and the average coughing time is 0.2 s/times. Therefore, in the second embodiment, winds are applied at a wind speed of 10 m/s for 10 seconds (equivalent to coughing 50 times) to each nonwoven fabric 1 produced using the suspension 11 with an AgHA concentration of 0.1%.

In both FIG. 5 and FIG. 6, no noticeable peeling of AgHA in each nonwoven fabric 1 after being exposed to each strong wind is observed.

Therefore, even if the nonwoven fabric 1 after AgHA application produced by the first embodiment is used as a mask filter or a mask, antibacterial and deodorizing effects of AgHA can be sufficiently obtained.

Third Embodiment

In a third embodiment, each relationship between each concentration of suspension 11, each particle size of AgHA, and each state of AgHA application to the nonwoven fabric 1 is described.

Figure 7:
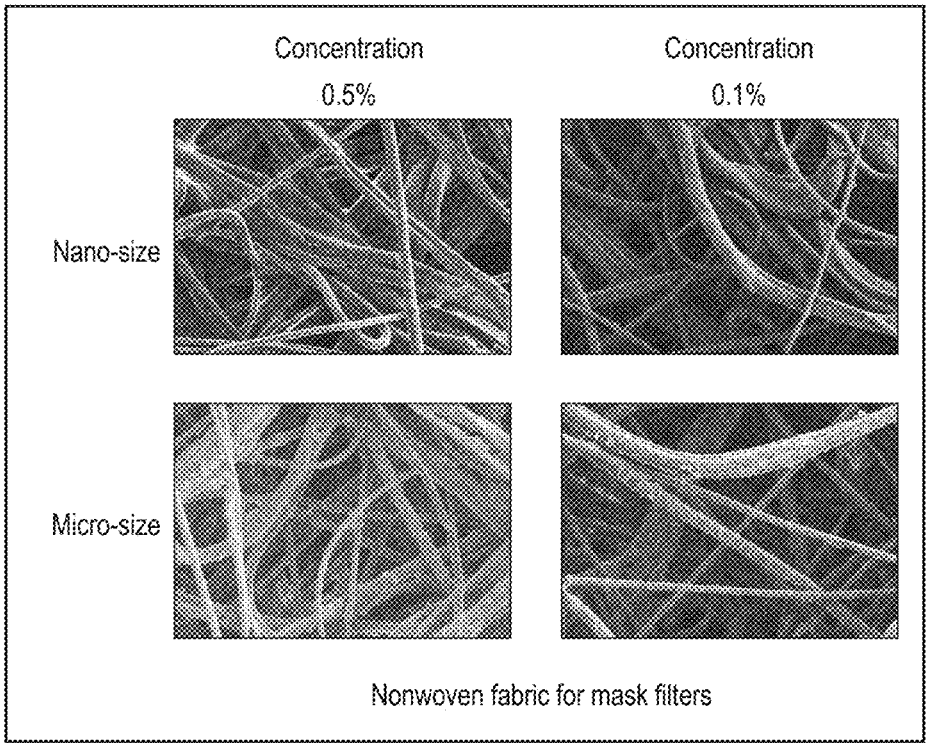
FIG. 7 is an enlarged view showing examples of relationships between the concentration of suspension, the particle size of AgHA, and states of AgHA application to nonwoven fabric.

FIG. 7 is an enlarged view showing examples of relationships between the concentration of the suspension 11, the particle size of AgHA, and the states of AgHA application to the nonwoven fabric 1.

Each nonwoven fabric 1 in FIG. 7 is a nonwoven fabric for a mask filter, and is produced by the application apparatus 2 and the application method according to the first embodiment above.

In FIG. 7, the nonwoven fabric 1 produced using the suspension 11 containing nano-sized AgHA at the concentration of 0.5% and the nonwoven fabric 1 produced using the suspension 11 containing nano-sized AgHA at the concentration of 0.1% are illustrated in an upper row. Note that the nonwoven fabric 1 produced using the suspension 11 containing nano-sized AgHA at the concentration of 0.05% or higher and 5.0% or lower, and the nonwoven fabric 1 produced using the suspension 11 containing nano-sized AgHA at the concentration of 0.01% or higher and 1.0% or lower are also the same as the upper row of FIG. 7.

In FIG. 7, the nonwoven fabric 1 produced using the suspension 11 containing micro-sized AgHA at the concentration of 0.5% and the nonwoven fabric 1 produced using the suspension 11 containing micro-sized AgHA at the concentration of 0.1% are illustrated in the lower row. Note that the nonwoven fabric 1 produced using the suspension 11 containing micro-sized AgHA at the concentration of 0.05% or higher and 5.0% or lower, and the nonwoven fabric 1 produced using the suspension 11 containing micro-sized AgHA at the concentration of 0.01% or higher and 1.0% or lower are also the same as the lower row of FIG. 7.

From the comparison in FIG. 7, AgHA with nano-sized particle size is more uniformly applied to the nonwoven fabric surface than AgHA with micro-sized particle size.

From this result, it can be understood that AgHA with nano-sized particle size is less likely to generate aggregates than AgHA with micro-sized particle size.

Therefore, the concentration of the suspension 11 containing nano-sized AgHA can be higher than that of the suspension 11 containing micro-sized AgHA.

Therefore, the suspension 11 containing AgHA with a smaller particle size can have a higher concentration to produce the nonwoven fabric 1, and the antibacterial effect and deodorizing effect of the nonwoven fabric 1 can be increased.

The above-explained embodiments are mere examples and are not intended to limit the scope of the invention. The above-explained embodiments may be embodied in a variety of other forms; furthermore, various omissions, substitutions and changes in the form of the above-explained embodiments may be made without departing from the spirit of the inventions. The accompanying claims and their equivalents are intended to cover such forms or modifications as would fall within the scope and spirit of the inventions.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An apparatus, comprising:

a tank that stores suspension containing hydroxyapatite;

a shower head that jets the suspension against a nonwoven fabric in the suspension in the tank;

an ultrasonic wave generator that emits ultrasonic waves against the nonwoven fabric; and a drying section that dries the nonwoven fabric in a wet state removed from the suspension in the tank.

2. The apparatus of claim 1, wherein the hydroxyapatite is silver-containing hydroxyapatite.

3. The apparatus of claim 1, wherein the shower head and the ultrasonic wave generator are arranged to face each other in the suspension stored in the tank, and the nonwoven fabric passes between the shower head and the ultrasonic wave generator.

4. The apparatus of claim 1, further comprising:

a first pump that allows the suspension flowing out of a first outlet formed in the tank to flow into an inlet formed in the tank; and a second pump that supplies the suspension flowing out of a second outlet formed at the bottom of the tank to the shower head.

5. The apparatus of claim 1, wherein the drying section comprises:

an enclosure comprising a first opening that carries in the nonwoven fabric in the wet state and a second opening that carries out the nonwoven fabric after drying;

a blowout port that discharges a wind toward the nonwoven fabric in the wet state in the enclosure; and a plurality of rollers that transport the nonwoven fabric carried into the enclosure from the first opening to the second opening.

6. The apparatus of claim 5, wherein the drying section further comprises a support stand that prevents at least one of the plurality of rollers from winding up the nonwoven fabric receiving the wind from the blowout port.

7. The apparatus of claim 6, wherein the blowout port discharges the wind toward the nonwoven fabric passing under the blowout port, and an upper surface of the support stand supporting the nonwoven fabric is net-like.

8. A method, comprising:

immersing a nonwoven fabric in suspension containing hydroxyapatite stored in a tank;

jetting the suspension against the nonwoven fabric by a shower head and emitting ultrasonic waves against the nonwoven fabric by an ultrasonic wave generator in the suspension in the tank; and drying the nonwoven fabric in a wet state removed from the suspension in the tank by a drying section.

* * * * *